United States Patent [19]

Shaffer

[11] 4,388,557

[45] Jun. 14, 1983

[54] HIGH INTENSITY DISCHARGE LAMP INCLUDING ARC EXTINGUISHING MEANS

[75] Inventor: John W. Shaffer, Williamsport, Pa.

[73] Assignee: GTE Products Corporation, Stamford, Conn.

[21] Appl. No.: 244,432

[22] Filed: Mar. 16, 1981

[51] Int. Cl.[3] ..... H01J 7/44; H01J 17/34; H01J 23/16; H01J 29/96; H01K 1/62

[52] U.S. Cl. ..... 315/74; 315/75; 200/263; 200/268

[58] Field of Search ..... 315/73, 74; 200/11 H, 200/263, 264, 265, 278, 268

[56] References Cited

U.S. PATENT DOCUMENTS

| | | | |
|---|---|---|---|
| 3,965,387 | 6/1976 | Stuart et al. | 315/73 |
| 4,001,634 | 1/1977 | Corbley et al. | 315/74 |
| 4,090,105 | 5/1978 | Koo | 315/74 |
| 4,195,251 | 3/1980 | Bamberg | 315/73 |
| 4,208,614 | 6/1980 | Strauss et al. | 315/74 |
| 4,233,542 | 11/1980 | Oostvogels et al. | 315/73 |

*Primary Examiner*—Saxfield Chatmon, Jr.
*Attorney, Agent, or Firm*—William H. McNeill

[57] ABSTRACT

A high intensity discharge device includes a reactive element which will oxidize and grow dimensionally to open the lamp circuitry in the event oxygen leaks into the outer envelope of the lamp.

5 Claims, 6 Drawing Figures

HIGH INTENSITY DISCHARGE LAMP INCLUDING ARC EXTINGUISHING MEANS

TECHNICAL FIELD

This invention relates to high intensity discharge lamps of the type employing an arc tube within an outer envelope. Arc extinguishing means are included within the outer envelope of the lamp for interrupting power to the arc tube in the event of breakage of the outer envelope.

BACKGROUND ART

High intensity discharge (HID) lamps such as mercury vapor, metal halide and high pressure sodium lamps, because of their high luminous efficacy, excellent lumen maintenance, relative low cost of light, good optical efficiency and ease of installation have been in general use for many years and are in increasing demand today. It has recently been publicized that, under certain conditions, these HID lamps may present a potential health hazard.

The light emitting member of these lamps, namely, the quartz arc tube containing mercury vapor or metal halide, and the alumina high pressure sodium discharge tube, all contain mercury as at least one of the constituent fill components. The mercury vapor lamp arc tube uses only mercury as the fill component (except for argon starting gas) and the resulting lamp discharge yields the well known mercury high pressure line spectrum with infrared, visible and ultraviolet radiation. The metal halide tube uses mercury plus combinations of various metal halide compounds as the fill components in addition to argon starting gas. The resulting spectrum will be characteristic of the metal introduced, augmented by the mercury line spectrum. The high pressure sodium lamp is filled with mercury and sodium in addition to starting gases of argon, xenon or neon or mixtures thereof. The spectrum of the discharge of this lamp is characteristic of high pressure sodium augmented by the line spectrum of mercury. Therefore, although ionized and excited mercury atoms are not the primary light producing species in metal halide and high pressure sodium arc tubes and lamps, sufficient mercury ionization and excitation occurs to produce visible and ultraviolet radiation of the characteristic mercury spectrum.

The characteristic mercury spectral lines produced by the discharges of the foregoing types of lamps produce ultraviolet radiation in the 200–297 nanometer range. Ultraviolet radiation in this range is potentially harmful. For example, conjunctivitis, an inflammation of the conjunctivae, will cause visual incapacitation and is caused by exposure to 250–297 nanometer radiation. Conjunctivitis when inflicted by exposure to the ultraviolet radiation is insidious as its symptoms do not appear until 2½ to 12 hours after exposure to such radiation. Numerous cases of ultraviolet radiation exposure causing abiotically produced cataracts of the eye lens have been reported. Even when such ultraviolet producing sources are viewed from considerable distances eye injuries can occur by ocular absorption.

Hermetically sealed outer glass envelopes are usually used to surround the light emitting tubes of HID lamps. This is done for three main reasons: (a) to obtain proper warm up and operating vapor pressures of the fill components by providing an inert gas or vacuum atmosphere between the discharge tube and the outer envelope, (b) to prevent the slow deterioration, due to oxidation, of the discharge tube lead-in wires and (c) to prevent the lamp from radiating the harmful ultraviolet energy produced by the inner tube.

With respect to point (c), the glass composition of the outer envelope is chosen so as to achieve absorption of the ultraviolet range causing known harmful effects. Therefore, when the outer glass envelope is intact, the harmful ultraviolet radiation emitted by the discharge tube is absorbed. When, for one reason or another, the glass envelope is broken the hermetically sealed light emitting discharge tubes of these lamps will continue to operate for tens to hundreds of hours and will not emit their harmful ultraviolet radiation to the surrounding areas, thus creating a health hazard to persons in those areas. An increasing number of HID lamps are used indoors where lamps, if operating with broken outer envelopes, will be of particular dnager becuase of the likelihood of lamp installations in close proximity to people.

Various solutions to this problem have been proposed by the prior art and these solutions can broadly be defined as: (1) means sensitive to an increase in oxygen in the outer envelope, (2) means sensitive to a change in pressure in the outer envelope, and (3) spring switch means held together by the actual condiguration of the glass outer envelope.

Examples of proposed solutions under item (1) above included U.S. Pat. Nos. 3,262,012 and 4,208,614 wherein an oxidizable filament is employed in the outer envelope which will burn through in the event the outer envelope breaks and admits air.

An example of an item (2) pressure sensitive device can be found in U.S. Pat. No. 4,143,301 in which a bellows switch is used in conjunction with an oxidizable filament.

An item (3) contact switch is disclosed in U.S. Pat. No. 4,156,830.

While all of the above-described solutions will work to a greater or lesser degree, problems exist with all of them.

The oxidizable filament is a fragile component which is subject to breakage from shocks.

The previously disclosed pressure sensitive devices are bulky and expensive and also employ, in conjunction therewith, an oxidizable filament.

The contact devices do not guarantee operation if the outer envelope is merely punctured at a spot remote from the switch.

DISCLOSURE OF INVENTION

It is, therefore, an object of this invention to obviate the disadvantages of the prior art.

These objects are accomplished, in one aspect of the invention, by providing, for dual envelope high intensity discharge lamps, an arc extinguishing means in the form of a bimetallic, serially connected switch which is included in the lamp circuitry. The switch is positioned internally of the outer envelope and externally of the arc discharge tube. The bimetallic switch comprises two materials, a first of which is substantially resistant to oxidation and a second of which is relatively rapidly oxidizable. The switch is so configured that, in the event of atmospheric oxygen being admitted within the outer envelope, the second material will combine with the oxygen and grow dimensionally to an extent to cause permanent flexure of the switch, this flexure opening the circuitry and extinguishing the lamp.

This switch is a rugged structure that is relatively inexpensive and positive in operation.

DESCRIPTION OF THE PREFERRED EMBODIMENTS

For a better understanding of the present invention, together with other and further objects, advantages and capabilities thereof, reference is made to the following disclosure and appended claims taken in conjunction with the above-described drawings.

Figure 1:
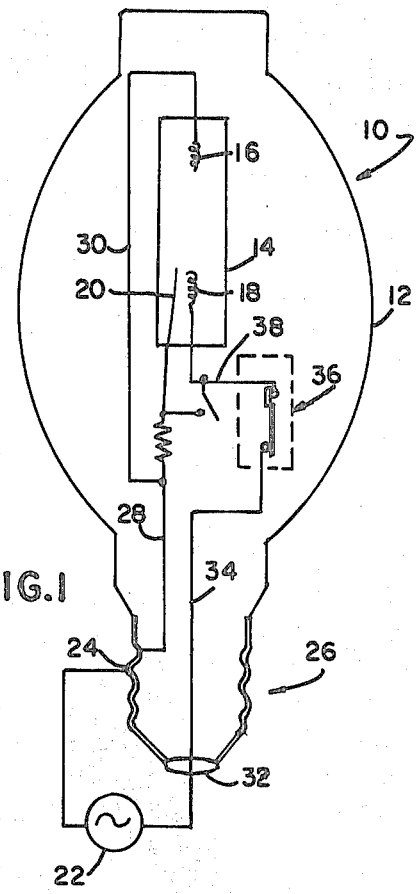
FIG. 1 is a diagrammatic illustration of a lamp employing the invention.

Referring now to the drawings with greater particularity, there is shown in FIG. 1 a high intensity discharge lamp 10 having an outer envelope 12 and an inner arc discharge tube 14. The discharge tube 14 has electrodes 16 and 18 therein, one at either end thereof, and includes an appropriate fill including at least mercury and a starting gas. In the lamp shown, an auxiliary or starting electrode 20 is positioned adjacent one of the main electrodes, e.g., 18, and is connected into the circuitry of the lamps, as is shown.

Electrode 16 is connected to one side of a power source 22, e.g., via the outside conductor 24 of base 26 and wires 28 and 30, while electrode 18 is connected to the other side of power source 22 via the central conductor 32 of base 26, wire 34, arc extinguishing switch 36 and wire 38.

Arc extinguishing switch 36 comprises a bimetallic, layered member 40 of a first material 42 and a second material 44. First material 42 is selected from the group of materials substantially resistant to oxidation and second material 44 is selected from a group of materials which are relatively rapidly oxidizable. The stable material is preferably selected from among nickel, copper, stainless steel, and iron while the oxidizing material is selected from among zirconium, titanium, hafnium, magnesium, yttrium, lanthanum, cerium, misch metal, uranium, thorium and alloys thereof.

Switch 36 can be fabricated in numerous configurations, some examples of which are shown in FIGS. 2–5.

Figure 2:
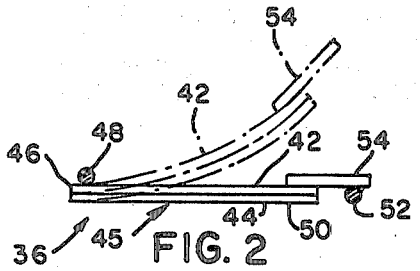
FIG. 2 is a plan view of one form of switch which can be employed.

In FIG. 2, switch 36 is an elongated, leaf-spring 45 having an end 46 permanently connected, as by welding, to a terminal 48, which can be an end of wire 34, and another end 50 in spring pressure engagement with a terminal 52, which can be an end of wire 38. A separate contact member 54 can be attached to end 50 to provide the actual contacting member.

Figure 3:
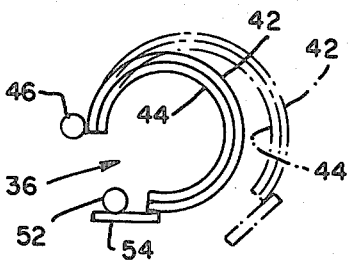
FIG. 3 is a plan view of an alternate form of switch.
Figure 5:
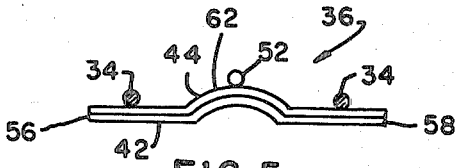
FIG. 5 is a plan view along the line 5—5 of FIG. 4 showing the switch in closed position.

In the embodiment shown in FIG. 3, switch 36 has a semi-circular configuration.

Figure 4:
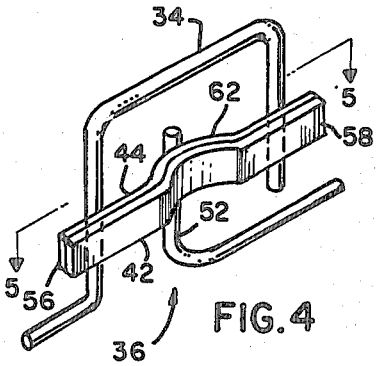
FIG. 4 is a perspective view of yet another alternate form of switch.
Figure 6:
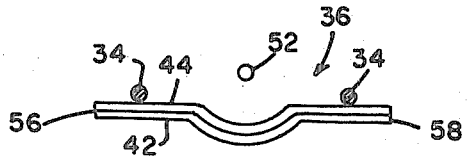
FIG. 6 is a view similar to FIG. 5 showing the switch in an open position.

The embodiment shown in FIG. 4 comprises a snap-action configuration wherein the ends 56, 58 of an elongated bimetal 60 are permanently attached to the same side of the circuit, as by welding across the bight of a "U" shaped bend formed in wire 34. An upstanding terminal 52 contacts the concavo-convex flex portion 62 of bimetal 60 and completes the circuit. The convex side of bimetal 60 is the oxidizable material 44. In the event of oxygen leakage into evelope 12 the rapidly oxidizing material 44 will combine therewith and grow dimensionally, causing the cancavo-convex flex portion 62 to flip, assuming the configuration shown in FIG. 6 and breaking the circuit.

Whatever configuration of switch 36 is employed, the switch should be located within envelope 12 adjacent arc tube 14 so that the rapidly oxidizable material 44 of the switch can be radiantly and conductively heated by the arc tube 14 to a temperature of about at least 300° C. or higher. Such a temperature range provides an ideal rate of oxidiation in the event of air leakage into the envelope 12.

It is also preferred that an inert fill gas such as argon be used within envelope 12 in place of the more commonly employed nitrogen, to avoid premature lamp shutdown. This is because the oxidizable materials employed would also be subject to nitride formations and such nitride formation, while slower than the oxidizing reactions, would also cause dimensional growth of the material 44 and subsequent flexure of the switch 36.

Further, it is desirable to mount switch 36, or its connecting members, in such a manner that complete or catastrophic breakage of envelope, which could cool the switch below its functioning temperature, would also mechanically break contact to the switch.

Alternatively, an independent pressure contact means can be employed in series with switch 36. Such pressure contact means are known in the art.

The bimetal element of switch 36, in any of its configurations, can comprise a bonded laminate of the two metals, or strips or foils of the two metals that are mechanically joined or attached at two or more places by rivets, welding, etc.

Further, the reactive bimetal element need not itself comprise part of the electrical circuit, but can also be used to merely provide the mechanical displacement to effect switching by independent members.

While there have been shown and described what are at present considered to be the preferred embodiments of the invention, it will be apparent to those skilled in the art that various changes and modifictions can be made herein without departing from the scope of the invention as defined by the appended claims.

I claim:

1. In a high intensity discharge lamp comprising an arc discharge tube mounted within an outer envelope enclosing a substantially oxygen-free environment, electrical circuitry for said lamp and arc extinguishing means operative to interrupt electrical power to said arc discharge tube in the event of rupture of said outer envelope, said arc extinguishing means comprising: a serially connected switch associated with said circuitry for said lamp, said switch comprising a bimetallic, layered element of at least two materials, a first of said materials being substantially resistant to oxidation and a second of said materials being relatively rapidly oxidizable, whereby, in the event of atmospheric oxygen being admitted within said outer envelope, said second of said materials will combine with said oxygen and grow dimensionally to an extent to cause permanent flexure of said switch, thereby opening said circuitry and extinguishing said lamp.

2. The lamp of claim 1 wherein said switch is an elongated, leaf-spring type having one end thereof permanently connected to one side of said circuit and another end in spring pressure engagement with another side of said circuit.

3. The lamp of claim 1 wherein said switch has a semi-circular configuration, one end thereof being permanently connected to one side of said circuit and another end thereof being in spring pressure engagement with another side of said circuit.

4. The lamp of claim 1, 2, or 3 wherein said first of said materials is selected from the group of nickel, copper, stainless steel, and iron and said second of said materials is selected from the group of titanium, zirconium, hafnium, magnesium, yttrium, lanthanum, cerium, misch metal, uranium, thorium and alloys thereof.

5. The lamp of claim 1 wherein said switch has both ends connected to the same side of said circuitry and a middle section which is concavo-convex attached to the other side of said circuitry.

* * * * *